United States Patent [19]

Matsuda

[11] 4,279,134

[45] Jul. 21, 1981

[54] WARP-KNIT STRINGER TAPE FOR SLIDE FASTENERS

[75] Inventor: Yoshio Matsuda, Nyuzen, Japan

[73] Assignee: Yoshida Kogyo, K.K., Tokyo, Japan

[21] Appl. No.: 50,294

[22] Filed: Jun. 20, 1979

[30] Foreign Application Priority Data

Jul. 7, 1978 [JP] Japan ..... 53-82761

[51] Int. Cl.[3] ..... D04B 21/00

[52] U.S. Cl. ..... 66/195

[58] Field of Search ..... 66/190–195; 24/205.1 C, 205.16

[56] References Cited

U.S. PATENT DOCUMENTS

| | | | |
|---|---|---|---|
| 3,965,833 | 6/1976 | Frohlich et al. | 112/265 |
| 3,974,550 | 8/1976 | Fujisaki et al. | 66/195 |
| 4,002,045 | 1/1977 | Frohlich et al. | 66/195 |
| 4,015,449 | 4/1977 | Matsuda et al. | 66/195 |
| 4,015,450 | 4/1977 | Matsuda et al. | 66/195 |
| 4,074,398 | 2/1978 | Matsuda et al. | 66/195 |

*Primary Examiner*—Ronald Feldbaum

*Attorney, Agent, or Firm*—Robert E. Burns; Emmanuel J. Lobato; Bruce L. Adams

[57] ABSTRACT

A warp-knit stringer tape for slide fasteners comprises a first set of yarns forming a knit ground structure containing stitch loops in every course and wale of the tape, and a second set of yarns knitted in the ground structure so as to form sinker loops located over the first set of yarns and each extending transversely across at least three wales, the second set of yarns including textured yarns. A third set of yarns are knitted in the ground structure so as to form chains of loops and extend along the wales in at least one of opposite tape edge portions. The first and third sets of yarns include multifilament synthetic yarns. A fourth set of yarns are laid in the ground structure and extend in and along the last-mentioned wales.

14 Claims, 11 Drawing Figures

WARP-KNIT STRINGER TAPE FOR SLIDE FASTENERS

BACKGROUND OF THE INVENTION

1. Field of the Invention

This invention relates generally to slide fasteners, and more particularly to a warp-knit stringer tape therefor made of synthetic fibers.

2. Prior Art

There have been a variety of warp-knit slide fastener stringer tapes made of synthetic fibers. It is a common knowledge to use multifilament synthetic fibers for such warp-knit fabrics to reduce their stretch to a minimum. The warp-knit tape of multifilament synthetic fibers has a relatively hard and slippery surface allowing the tape to slip out of place during attachment onto a garment on a sewing machine with the results that the tape develops creases or puckers.

One solution to this slippage has been to incorporate in the tape two different types of inlaid wefts, one made of textured yarns and the other of synthetic fibers of high shrinkability, the textured yarns being bulged on the front side surface of the tape by shrinkage of the synthetic fiber wefts, thereby increasing the frictional coefficiency of the tape as it is held against a garment during sewing. The use of such different inlaid wefts, however, makes the tape become thickened at its central portion and too resistant to the penetration therethrough of a sewing needle. Further, this prior art tape encounters different shades or tints when dyed or otherwise treated, because there appear different types of yarns on the front side surface of the tape.

SUMMARY OF THE INVENTION

It is therefore an object of this invention to provide a warp-knit slide fastener stringer tape having a coupling element supporting edge which is structurally tight and resistant to longitudinal stretch.

Another object of the invention is to provide a warp-knit stringer tape having a central portion which is relatively coarse for facilitating correct and easy stitching therethrough.

Still another object of the invention is to provide a warp-knit stringer tape having a soft, fuzzy, fulged surface which is free from different shades or tints when dyed or otherwise treated.

According to the invention, a warp-knit stringer tape for slide fasteners comprises a knit ground structure formed by a first set of yarns knitted so as to form stitch loops in every course and wale of the tape, the first set of yarns including multifilament synthetic fibers. A second set of yarns are knitted in the ground structure so as to form sinker loops located over the first set of yarns and each extending transversely across at least three wales, the second set of yarns including textured yarns. A third set of yarns are knitted in the ground structure so as to form chains of loops, and extend along the wales in at least one of opposite tape edge portions. The third set of yarns include multifilament synthetic yarns. A fourth set of yarns are laid in the ground structure and extend in and along the last-mentioned wales.

The above and other objects, features and advantages of this invention will become apparent from the following description when taken in conjunction with the accompanying drawings in which some preferred embodiments are shown in by way of illustrative example.

DETAILED DESCRIPTION

Figure 1:
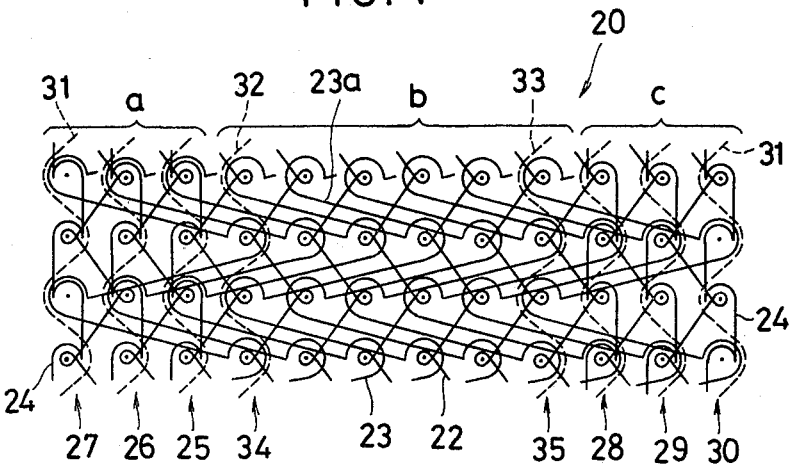
FIG. 1 is a point diagram showing the patterns of a plurality of sets of yarns in a warp-knit stringer tape according to a first embodiment of the invention.
Figure 3:
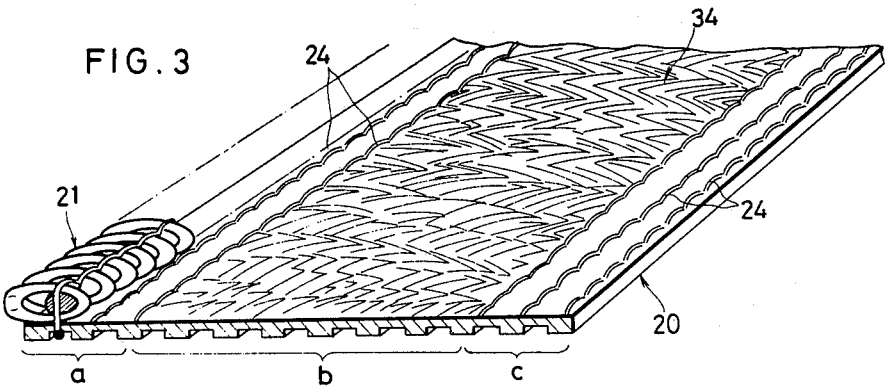
FIG. 3 is a perspective view of a slide fastener stringer with the warp-knit stringer tape according to the first embodiment.
Figure 4:
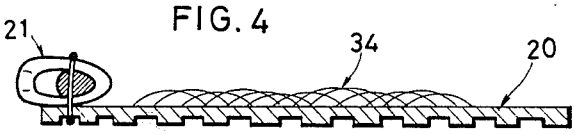
FIG. 4 is a transverse cross-sectional view of the slide fastener stringer of FIG. 3.

As shown in FIG. 1, a warp-knit stringer tape 20 according to a first embodiment of the invention has a pair of spaced edge portions a,c on one of which a row of coupling elements 21 (FIGS. 3 and 4) is to be mounted, and a central portion b extending between the edge portions a,b, the tape 20 being adapted for attachment onto a garment (not shown) by sewing threads passing through the central portion b.

The tape 20 comprises a knit ground structure formed by a first set of yarns 22 knitted in a pattern of 1-2/1-0 (C in FIG. 2), the ground structure thus containing stitch loops of the tape 20. A second set of yarns 23 are knitted in the ground structure in a pattern of 0-1/4-3 (B in FIG. 2), and each extends transversely across four wales or three inter-needle spaces. The first and second set of yarns 22,23 extend transversely for the full width of the tape 20, that is in both the edge portions a,c and the central portion b.

Figure 2:
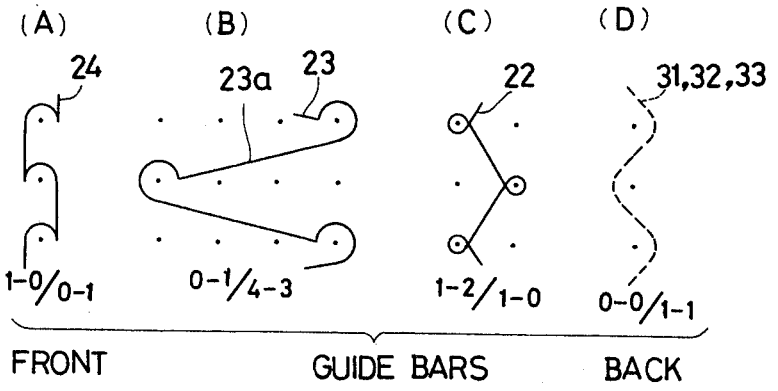
FIG. 2 is a diagram showing the guide-bar movement for the yarns shown in FIG. 1.

Each of the tape edge portions a,c further includes a third set of yarns 24 (three in the illustrated embodiment) of synthetic fibers knitted in a pattern of 1-0/0-1 (A in FIG. 2). The third set of yarns 24 form a plurality of chains of loops and extend along three outermost wales 25,26, and 27 in the edge portion a and three outermost wales 28,29, and 30 in the edge portion c. Additionally included in each of the tape edge portions a,c are a fourth set of yarns 31 (three in the embodiment) laid in the ground structure in a pattern of 0-0/1-1 (D in FIG. 2) and extending in and along the wales 25,26 and 27 (28,29 and 30). A pair of additional yarns 32,33 are also laid in the ground structure in a pattern of 0-0/1-1 (D in FIG. 2), and extend in and along a pair of wales 34,35 respectively in the central portion **20*b* which are next respectively to the wales 25,28** in the edge portions a,c.

The second set of yarns 23 comprise textured yarns, and the first and third sets of yarns 22,24 comprise multifilament yarns.

The tape 20 is made on a warp knitting machine (not shown) equipped with four guide bars. The first, second, and third sets of yarns 22,23 and 24 are threaded respectively in the third, second, and first (front) guide bars, while the fourth set of yarns 31 and the additional yarns 32,33 are threaded in the fourth (back) guide bar. Notations of the four guide bars are illustrated in FIG. 2.

With the warp-knit stringer tape 20 thus formed, sinker loops 23*a* of the second set of yarns 23 are located over the first set of yarns 22 for the full width of the tape 20, and there are no yarns (third set of yarns 24) located over the sinker loops 23*a* of the second set of yarns 23 except at the edge portions a,c. This permits the sinker loops 23*a* of such textured yarns 23 at the central portion b of the tape 20 to be raised from the ground structure on its front side, providing a soft, fuzzy, bulged surface 34 (FIGS. 3 and 4) which prevents the tape 20 from slipping during attachment onto a garment. Such surface 34 presents a velvet-like appearance. The central portion b of the tape 20 has a relatively coarse structure which will facilitate the penetration of a sewing needle therethrough. Because of inlaid yarns 31,32,33 which engage tightly with the stitch loops along the wales 25 through 30 and the wales 34,35, the tape edge portions a,c are structurally tight and resistant to longitudinal stretch.

Figure 5:
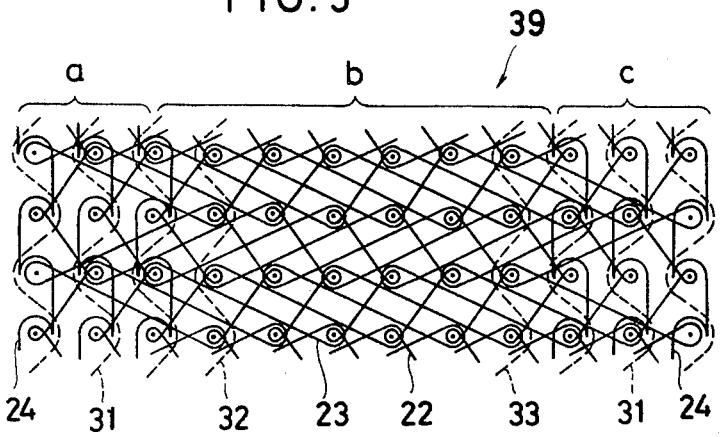
FIG. 5 is a point diagram similar to FIG. 1 but showing the patterns of a plurality of sets of yarns in a warp-knit stringer tape according to a second embodiment.
Figure 6:
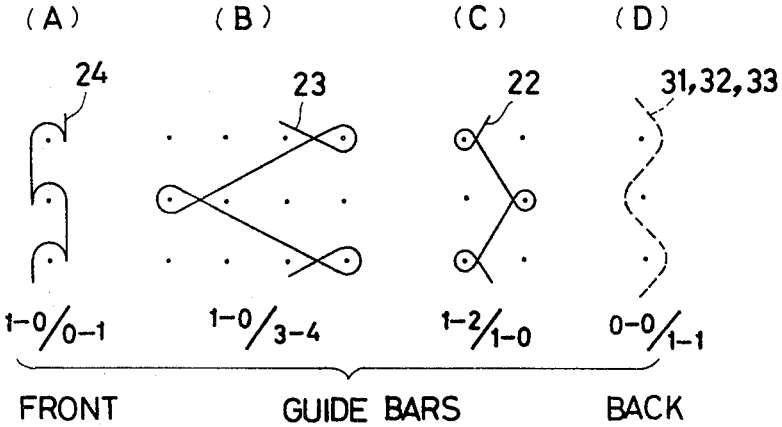
FIG. 6 is a diagram showing the guide bar movement for the yarns shown in FIG. 5.

FIGS. 5 and 6 illustrate a warp-knit stringer tape 39 according to a second embodiment. The tape 39 is substantially similar to the tape 20 of the first embodiment (FIGS. 1 and 2) and differs therefrom only in that the second set of yarns 23 (textured yarns) are knitted in a pattern of 1-0/3-4 instead of 0-1/4-3.

Figure 7:
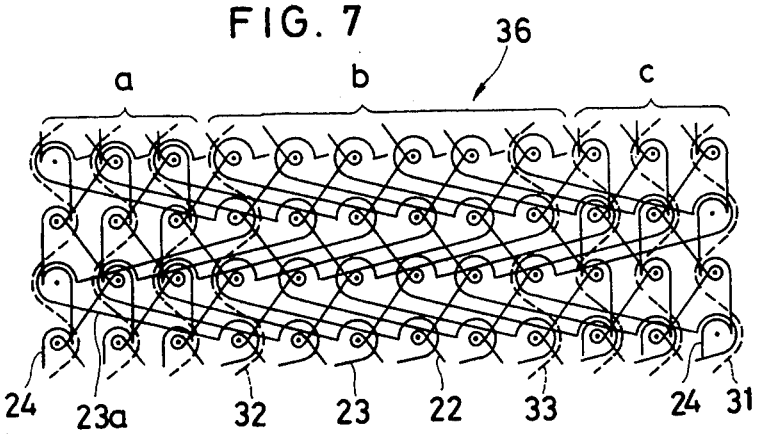
FIG. 7 is a point diagram similar to FIG. 1 but showing the patterns of a plurality of sets of yarns in a warp-knit stringer tape according to a third embodiment.
Figure 8:
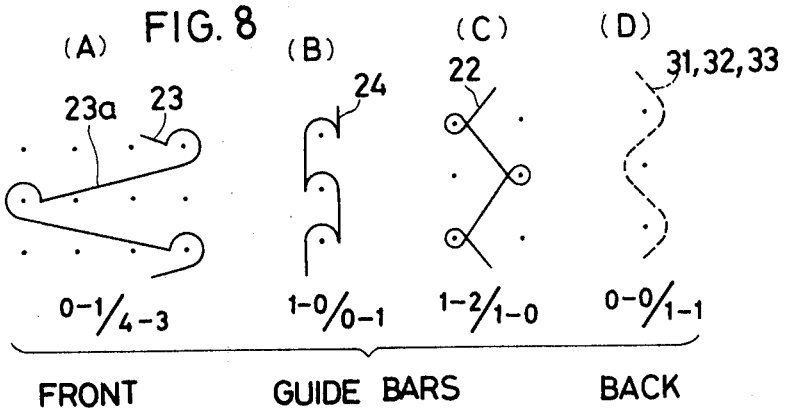
FIG. 8 is a diagram showing the guide bar movement for the yarns shown in FIG. 7.
Figure 9:
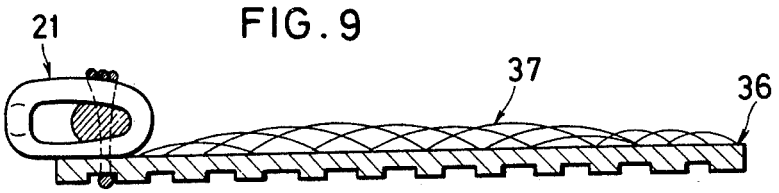
FIG. 9 is a transverse cross-sectional view of a slide fastener stringer with the warp-knit stringer tape of the third embodiment.

As shown in FIGS. 7 and 8, a warp-knit stringer tape 36 of a third embodiment is different from the tape 20 of the first embodiment only in that the second set of yarns 23 (textured yarns) are threaded in the front guide bar with a pattern of 0-1/4-3, while the third set of yarns 24 are threaded in the second bar with a pattern of 1-0/0-1. With the tape 36 thus formed, there are no yarns (third set of yarns 24) overlying the sinker loops 23*a* of the textured yarn 23 at the edge portions a,c as well as at the central portions b. The result is that the tape 36 is covered on its front side totally with the sinker loops 23*a* of the textured yarns 23, as shown in FIG. 9. In other words, there appears one and the same type of yarns on the front side surface of the tape 36. Such tape surface 37 can therefore be dyed or otherwise treated without providing different shades or tints which would otherwise be present due to the use of different types of yarns.

Figure 10:
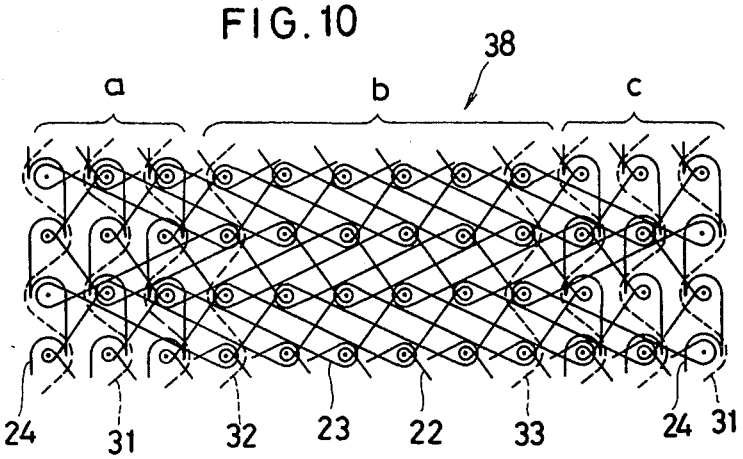
FIG. 10 is a point diagram similar to FIG. 7 but showing the patterns of a plurality of yarns in a warp-knit stringer tape according to a fourth embodiment.
Figure 11:
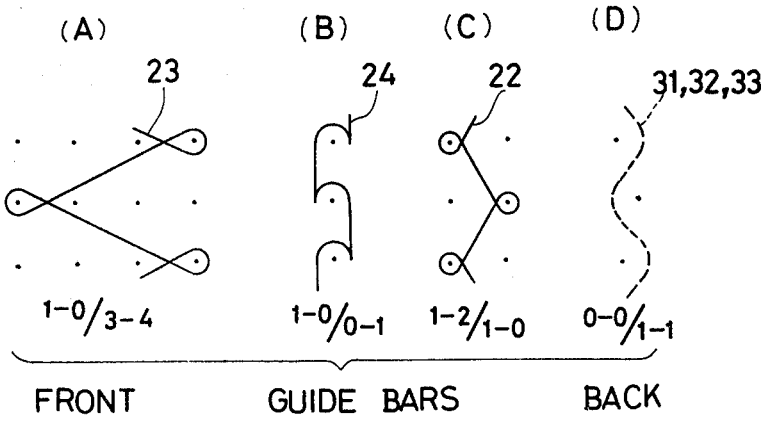
FIG. 11 is a diagram showing the guide-bar movement for the yarns shown in FIG. 10.

FIGS. 10 and 11 illustrate a warp-knit stringer tape 38 of a fourth embodiment. The tape 38 is substantially similar to the tape 36 of the third embodiment (FIGS. 7 and 8) with the exception that the second set of yarns 23 (textured yarns) are knitted in a pattern of 1-0/3-4 instead of 0-1/4-3.

Although some preferred embodiments have been shown in and described, it should be understood that changes and modifications may be made without departing from the scope of the appended claims. For example, the second set of yarns 23 (textured yarns) may be knitted in other alternative patterns: 0-1/3-2, 0-1/5-4, 1-0/2-3 or 1-0/4-5.

What is claimed is:

1. A warp-knit stringer tape for slide fasteners having a pair of spaced edge portions and a central portion extending between said edge portions, said stringer tape comprising:

(a) a first set of yarns forming a knit ground structure containing stitch loops in every course and wale of said tape;

(b) a second set of yarns knitted in said ground structure and each extending coursewise across at least three wales, sinker loops of said second set of yarns being located, on one of opposite surfaces of the stringer tape, over said first set of yarns of said ground structure;

(c) a third set of yarns forming a plurality of chains of loops knitted in said ground structure and extending along wales in at least one of said edge portions; and (d) a fourth set of yarns laid in said ground structure and extending in and along the last-named wales.

2. A warp-knit stringer tape according to claim 1, said third set of yarns being located over said sinker loops of said second set of yarns, whereby one of opposite surfaces of said tape is covered with said sinker loops of said second set of yarns only in said central portion.

3. A warp-knit stringer tape according to claim 1, said third set of yarns being located under said sinker loops of said second set of yarns, whereby one of opposite surfaces of said tape is totally covered with said sinker loops of said second set of yarns.

4. A warp-knit stringer tape according to claim 1, said second set of yarns including textured yarns.

5. A warp-knit stringer tape according to claim 1, said first and third sets of yarns including multifilament yarns.

6. A warp-knit stringer tape according to claim 1, said first set of yarns being knitted in a pattern of 1-2/1-0.

7. A warp-knit stringer tape according to claim 1, said second set of yarns being knitted in a pattern of 0-1/4-3.

8. A warp-knit stringer tape according to claim 1, said second set of yarns being knitted in a pattern of 1-0/3-4.

9. A warp-knit stringer tape according to claim 1, said second set of yarns being knitted in a pattern of 0-1/3-2.

10. A warp-knit stringer tape according to claim 1, said second set of yarns being knitted in a pattern of 0-1/5-4.

11. A warp-knit stringer tape according to claim 1, said second set of yarns being knitted in a pattern of 1-0/2-3.

12. A warp-knit stringer tape according to claim 1, said second set of yarns being knitted in a pattern of 1-0/4-5.

13. A warp-knit stringer tape according to claim 1, said third set of yarns being knitted in a pattern of 1-0/0-1.

14. A warp-knit stringer tape according to claim 1, said fourth set of yarns being laid in a pattern of 0-0/1-1.

* * * * *